US005749256A

United States Patent [19]

Bodnar

[11] Patent Number: 5,749,256

[45] Date of Patent: May 12, 1998

[54] METHOD AND APPARATUS FOR MANUFACTURING A HOT ROLLED BEAM

[75] Inventor: Ernest R. Bodnar, Don Mills, Canada

[73] Assignee: Rotary Press Systems Inc., Toronto, Canada

[21] Appl. No.: 640,907

[22] PCT Filed: Nov. 8, 1994

[86] PCT No.: PCT/CA94/00620

§ 371 Date: May 9, 1996

§ 102(e) Date: May 9, 1996

[87] PCT Pub. No.: WO95/13151

PCT Pub. Date: May 18, 1995

[30] Foreign Application Priority Data

Nov. 12, 1993 [CA] Canada ..... 2103002

[51] Int. Cl.[6] ..... B21D 28/32

[52] U.S. Cl. ..... 72/333; 72/335; 72/355.4; 72/359; 29/897.3; 52/634; 52/729.1

[58] Field of Search ..... 72/335, 333, 327, 72/312–315, 355.4, 359, 355.2, 342.94; 29/897.3, 897.31, 897.312; 52/634, 729.1

[56] References Cited

U.S. PATENT DOCUMENTS

| | | | |
|---|---|---|---|
| 669,639 | 3/1901 | Hessel | 52/729.1 |
| 1,528,587 | 3/1925 | Thackray | 72/335 |
| 1,693,987 | 12/1928 | Koelkebeck . | |
| 1,707,008 | 3/1929 | Havemeyer | 52/634 |
| 1,759,481 | 5/1930 | Dougherty et al. . | |
| 1,812,023 | 6/1931 | Seavey | 72/355.4 |
| 2,167,666 | 8/1939 | McGee | 52/634 |
| 2,636,253 | 4/1953 | Rees | 72/359 |
| 3,091,277 | 5/1963 | Schmitt | 72/312 |
| 4,111,029 | 9/1978 | Dulaquais | 72/342.94 |
| 4,793,113 | 12/1988 | Bodnar | 52/634 |

FOREIGN PATENT DOCUMENTS

| | | | |
|---|---|---|---|
| 0 324 206 | 7/1989 | European Pat. Off. . | |
| 1237246 | 6/1959 | France . | |
| 145314 | 8/1983 | Japan | 72/335 |
| 1412841 | 7/1988 | U.S.S.R. | 72/335 |
| 1581414 | 7/1990 | U.S.S.R. | 72/335 |

*Primary Examiner*—Daniel C. Crane
*Attorney, Agent, or Firm*—Jon Carl Gealow

[57] ABSTRACT

A method of manufacturing a one piece integral metallic beam (22) having flanges (24), and a web (26) joining said flanges, the beam having been hot rolled from a heated metal workpiece (20) to produce an integral one piece beam having flanges and a web extending therebetween, the flanges having a predetermined first thickness, and the web having a predetermined second thickness less than the first thickness, and in which the web is heated to a hot forming temperature, without substantially heating the flanges and, the web is than passed through at least one metal forming die set (16), which is repeatedly closed on the web to form the web without forming the flanges. The method may also include the piercing of openings (28) through the web, and the forming of lips (30) around the openings, and also, the forming of a secondary product (52) from the portion of the web discarded from the opening, and also hot forging the lips (30) around the openings. Also disclosed is apparatus for carrying out the method, and a forming and forging die for both forming and forging a metal workpiece.

17 Claims, 10 Drawing Sheets

30
24
32
28
26
24

32
30
5
36
28
40
24
42
34
44
48
36
46
34
42
26
24
42
46
48
40
44

28
24
22a
26
24
32a
28a
24a
26a

METHOD AND APPARATUS FOR MANUFACTURING A HOT ROLLED BEAM

This application is a 371 of PCT/CA94/00620, filed Nov. 8, 1994.

TECHNICAL FIELD

The invention relates to a hot rolled metal beam, and a method of manufacturing such a beam, and in particular to such a hot rolled beam having flanges and a web joining the flanges and wherein the flanges have a predetermined first thickness and wherein the web has a predetermined second thickness less than said flange thickness, and wherein said web has openings formed therein, and to a forging die for forging portions of such a beam, or for cold forging other metal members.

BACKGROUND ART

Hot rolled metal beams typically being manufactured of steel, although other metals may also be used, are used in a wide variety of load bearing applications. In most cases, they employ a pair of flanges spaced apart from one another, and a web joining the flanges. Typical such beam sections are an I-section, and a C-section, and more complex sections. Such beams may be used in the construction of various buildings, heavy vehicles, road and bridge construction. In many of such applications, it is desirable to fabricate the beam in such a way as to maximize strength, and to reduce the actual metal content of the beam. Where numerous beams are used for example in a building, it will also reduce the overall weight of the building.

In particular, the so called "castellated" beam shows many of these advantages. This beam typically is formed of a solid I-section hot rolled beam. The I-section is then cut along the middle of the web, usually into a more or less zig-zag pattern. The two halves of the beam are then rewelded together with the peaks of the zig-zag portions in contact with one another. The zig-zags thus form openings between the joined peaks. An example is shown in U.S. Pat. No. 4,894,898, Inventor P. A. Walker.

The resultant fabricated castellated beam is considerably deeper through the web, than the original beam, but the flange portions of the beam remain unchanged.

Such a beam will have increased load bearing capacity as compared with the original solid I-beam section, without containing any additional metal, and thus, without any increase in weight, as compared with a solid I-beam.

Castellated beams also have the advantage that by providing openings through the web of the beam, it becomes possible to pass services through the beam. Clearly this is not possible using a conventional beam with a solid web.

It would however be clearly desirable if a method could be developed for making a beam, with openings pierced through the web, but without the expensive and time consuming cutting and welding operation and also without the need for trimming the ends of the beam.

If a beam can be rolled, with flanges of standard thickness and with a web which is substantially thinner than the standard web thickness, of a conventional beam, while overcoming web the distortion problem, significant reductions in the cost of such beams could be obtained without a corresponding penalty of loss of capacity.

In the foregoing general remarks, while references have been made to castellated beams, it will be appreciated that the demand for castellated beams is only a very small fraction of the demand for hot rolled beams. The advantages described above, when such improved beams are compared with conventional beams, which represent by far the largest portion of the market, are very considerable, and represent a major breakthrough in the manufacture of such beams.

DISCLOSURE OF THE INVENTION

With a view to achieving the foregoing objectives the invention comprises a method of manufacturing a hot rolled beam, said beam having flanges of a predetermined first thickness, and a web extending between said flanges, said beam being initially rolled in a hot rolling mill to provide a beam member having continuous flanges, and a web joining the same, and said flanges having a predetermined first thickness, and said web having a predetermined second thickness less than said first thickness, and said beam member having been then cooled, and comprising the steps of, reheating said beam member to a temperature in the range of between about 500° C. and 1200° C., passing said heated beam member through a metal forming press, repeatedly operating said press to form a series of spaced apart openings through said web, and operating of said press simultaneously hot forming the remainder of said web to remove distortion, and thereafter allowing said beam member to cool.

A further advantageous feature of the invention is the forming of lips around said openings, said lips being formed at an angle to the plane of said web.

A further advantageous feature of the invention is focusing the heat required for reheating the beam, so as to reheat only the web to a high temperature, while leaving said flanges at a lower temperature.

A further advantageous feature of the invention is the forming of indentations in said web adjacent to said openings.

A further advantageous feature of the invention is the forming of the discard portions of said web within said openings, prior to or during their removal from the web, to provide a secondary product from such discard portions, after which the remainder of said discard portions of said web are removed to form said openings as aforesaid.

A further advantageous feature of the invention is to hot forge the lips formed around said openings, whereby to increase their thickness, and also, in some cases to increase the angle of said lips relative to the plane of said web.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

MODES OF CARRYING OUT THE INVENTION

Figure 1:
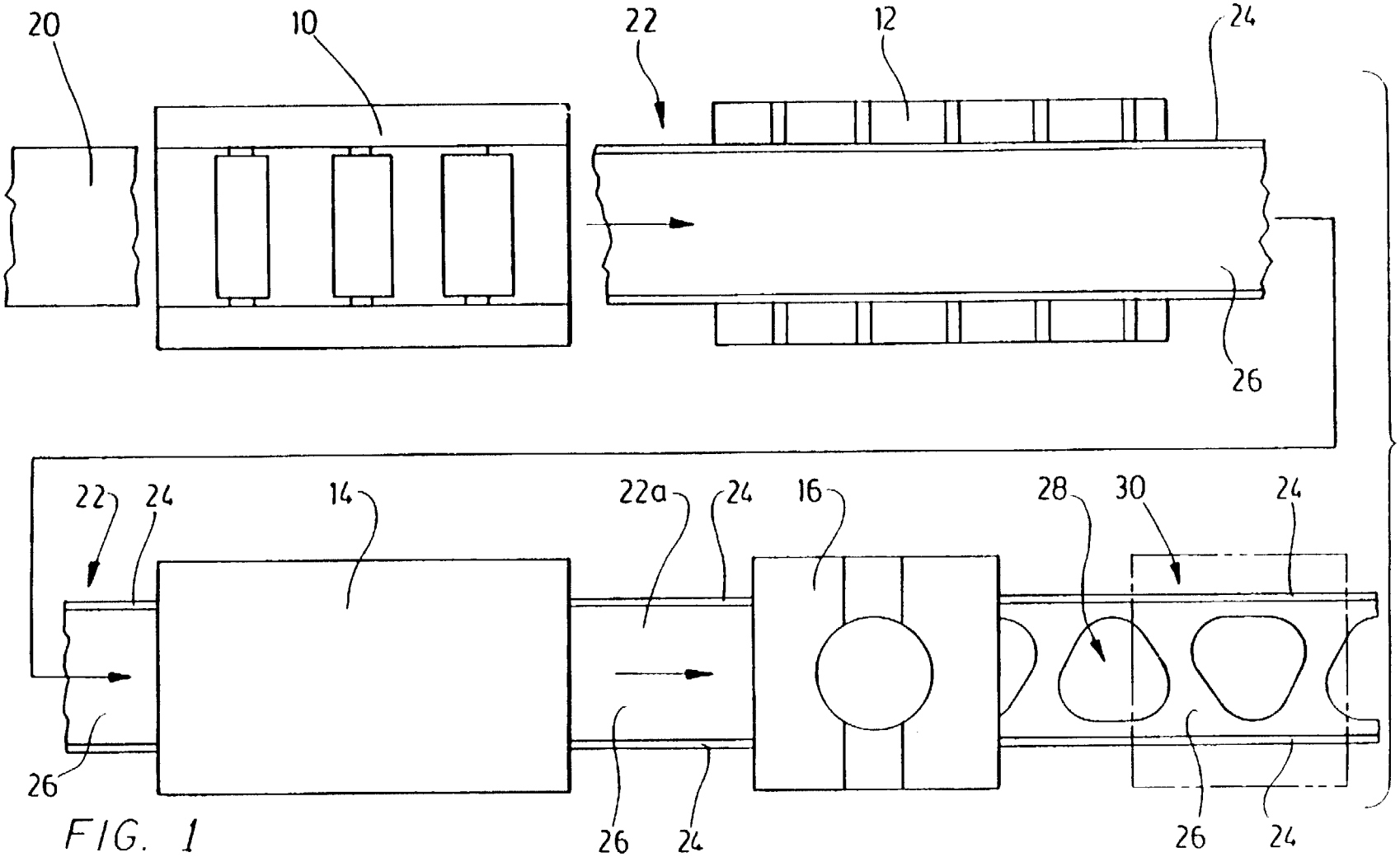
FIG. 1 is a schematic block diagram of a facility for producing beams in accordance with the invention.

Referring first of all to FIG. 1, it will be observed that this drawing illustrates, in schematic form, a manufacturing facility for carrying out the invention.

The facilities comprise a hot rolling mill indicated generally as 10 for hot rolling beams, a storage location 12 for cooling beams, a heating chamber 14 for reheating beams, and a metal forming press 16 for forming the webs of the beams. Optional further presses (not shown) might be added, for purposes to be described below.

Figures 2, 3:
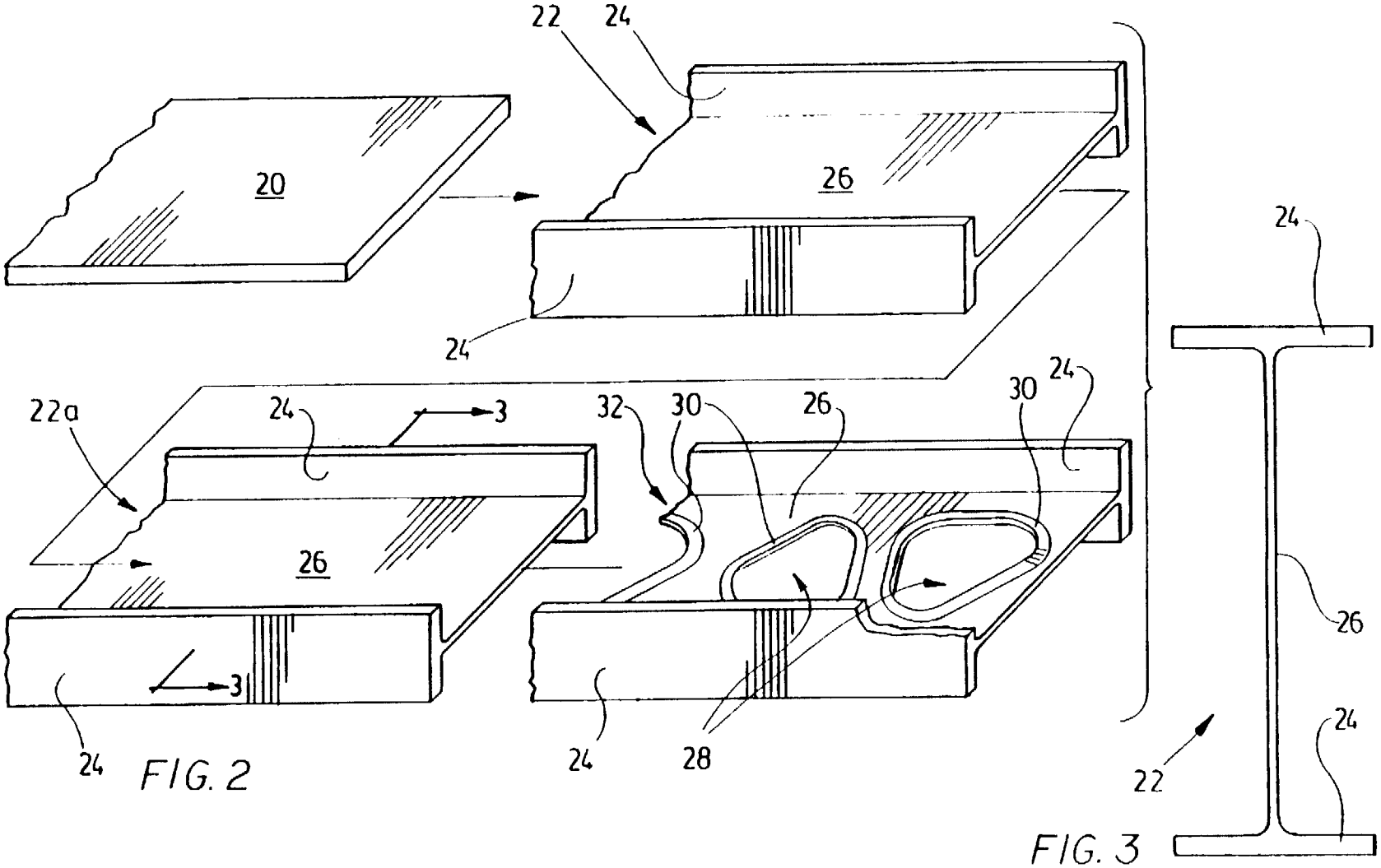
FIG. 2 is a schematic step diagram showing the sequence of operations for converting a known metal beam member into a beam in accordance with the invention.
FIG. 3 is an end view of one embodiment of a beam at its first step in its manufacture in accordance with the invention.

Referring now to FIGS. 1 and 2, the steps of the process will be described with reference to the shape of the beam member at various stages in the process. A typical bar or billet of metal is indicated as 20. It may be seen to be of generally flat rectangular section, or "dog bone" shape in some cases. It is at an elevated temperature, for example in the region of between 500° C. and 1200° C., in the case of ferrous metal.

However other metals and alloys of metal may be hot rolled at varying temperatures.

As the bar 20 is passed along the hot rolling mill line 10 it is shaped into the desired beam shape, which is illustrated here as 22, in the form of a typical I-beam, although this is merely an example and without limitation to any particular shape.

In many cases, in many hot rolling mills the beam is passed first in one direction, and then in the other, so that it passes several times to and fro along the line.

The finished beam is then allowed to cool at the cooling station 12 described above.

It will be observed that the section of the I-Beam (FIG. 3) defines two flanges 24—24 of a predetermined first thickness, and a web 26 joining the two flanges of a predetermined second thickness. The web thickness will be seen to be substantially less than the flange thickness, and the web may exhibit a certain degree of distortion, (not shown) when the beam cools.

The I-beam 22 is then subjected to re-heating, for example in the heating chamber 14 (described below). As explained above the heating chamber 14 is preferably of such a design that the heat is concentrated and focused so as to heat the web, while minimizing the temperature rise of the flanges. This is a significant important feature of the invention for reasons which will be apparent as this description proceeds.

The web temperature will be raised to a "hot forming" temperature. Typically this will be between about 5000° C. and 1200° C.

From the heating chamber, the I-beam, with heated web indicated as 22A in FIG. 2 is then passed through one or more metal forming presses 16, where for example openings 28 are formed, with lips 30 (FIG. 4) formed around the openings at an angle to the plane of the web, to provide the finished beam 32.

In most cases the openings 28 pierced through the beam will be surrounded by lips 30, in order to provide maximum strength to the web.

In some cases however it is conceivable that the openings may be pierced without such lips.

Figures 4, 5, 5A:
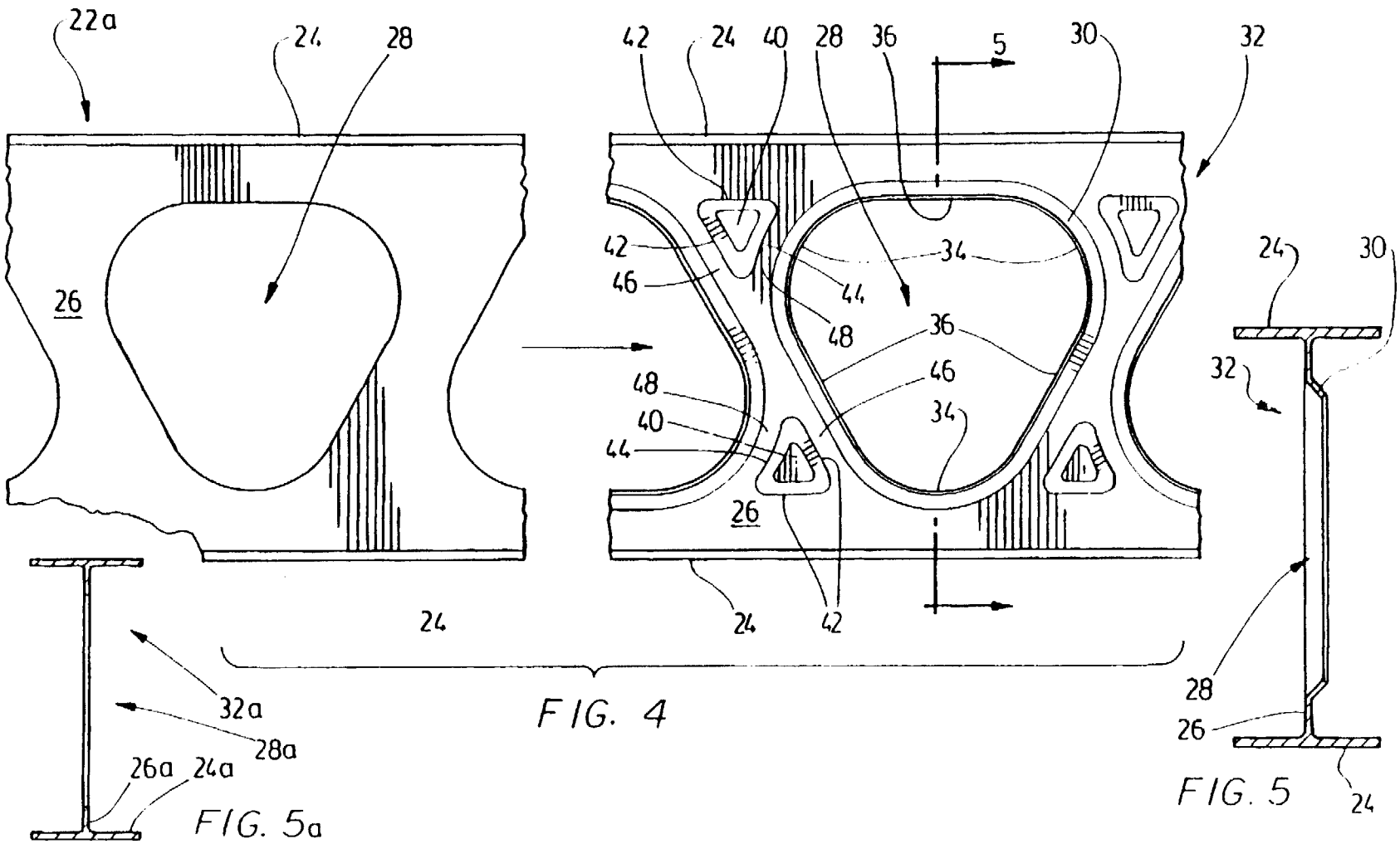
FIG. 4 is a schematic stepwise illustration showing the steps in the forming of an opening in the web of the beam.
FIG. 5 is a section along line 5-5 of the beam illustrated in FIG. 4.
FIG. 5*a* illustrates a beam similar to FIG. 5 with openings but without lips.

FIG. 5*a* illustrates in section a beam formed with openings but without lips.

In FIG. 5*a* the features corresponding to FIG. 5 are indicated with the same reference numerals, with the suffix a.

The dies (FIG. 9 & 10) in the press are so designed as to form the web, while leaving the flanges untouched. In general however, the die set in the illustrated embodiment is designed so that it will punch or pierce an opening (or two openings) through the heated web, and preferably simultaneously form lips around the openings. Preferably also the dies will have flat planar forming surfaces around the punch formations, which planar forming surfaces will engage and form the web around the opening so as to render the web flat, and to correct any distortion that may have occurred during hot rolling, and subsequent cooling of the beam, due to its reduced thickness web, as compared with the thickness of the flanges.

While the openings may be of any desired shape such as circular, or in this case generally triangular, with rounded corners, the planar forming surfaces will be rectangular so as to engage and form a maximum area of the web, in each operation of the die set, so that each time the die set closes, substantially the entire area of the web remaining around the opening, from one flange to the other, is flattened to correct distortions.

For the triangular shaped openings shown it would be necessary to provide either two punch dies in one press, or two presses, each with a single punch die.

The punching out of a portion of the web reduces the overall weight of the beam. The forming of lips around the opening strengths the web, and the forming and flattening of the remainder of the web both flattens and strengthens the web.

After cooling, the flanges of the beam will usually be subjected to a straightening operation (known per se) which is not illustrated.

In the end result, the finished pierced web beam has load bearing capabilities substantially equal to that of a standard, solid web beam of equivalent flange dimensions and equivalent web depth (but greater web thickness, in most cases), while being much more economical to produce. In most cases, the finished pierced web beam will have a web thickness which is substantially less than the web thickness of a standard solid web beam. This is because by the operation of the press, or presses, on the web, web distortion, which would otherwise result from the reduced web thickness is eliminated by a hot stamping operation.

Thus not only is substantial web metal removed by the piercing of the web to provide the openings, but in addition, the web thickness is reduced as compared with a standard solid web beam. Thus the overall weight or mass of the beam is substantially reduced as compared with a solid web beam.

Major economies result from both features of the invention.

It will be observed (FIG. 4) that the openings 28 are of more or less triangular shape, having rounded corners 34 with a relatively long radius, and linear side edges 36.

The triangular shaped openings 28 will be seen to be directed alternately towards opposite sides of the web, thereby defining more or less diagonal struts 38 of the web, separating one triangular opening from the next.

The flanges 30 formed around the openings 28 will thus be seen to extend along either side edge of each strut 38. This arrangement of struts and flanges, forming essentially channel-like shapes in section, gives the web great strength, notwithstanding the removal of substantial portions of the web metal at the openings, and produces a significant reduction in weight, in addition to the savings in weight achieved by, in most cases, utilizing a web with considerably reduced thickness as compared to webs of standard solid web beams.

Furthermore, the finished pierced web beam has many of the advantages of castellated beams. It has a much higher strength to weight ratio than a solid web beam, and at the same time it permits the passing of services through the beam. Thus the advantages of a castellated beam are obtained, in a beam of equivalent size to the size of a standard beam, without the additional depth of the castellated beam and without the greatly increased cost of the castellated beam. Such a pierced web beam is thus directly competitive with a standard solid web beam, and from many aspects has considerable advantages as compared to a solid web beam.

In a typical case, the piercing of the web of the beam to provide the spaced apart openings will provide openings which extend across approximately 75% of the width of the web, leaving approximately 12½% of the web metal remaining on each side of the opening.

The actual metal removed from the web will usually be in the region of 50% of the web metal. This will give an indication of the major economies that can result from the invention As already outlined above, still further strength can be added to the web, by the provision of generally triangular indentations 40, at each end or "root" of each strut 38.

Each of the generally triangular indentations 40 will be seen to have two linear sides 42, and a third generally curved side 44. One of the two linear sides is the base of the triangle, and is generally parallel to the flanges 12 of the beam.

The generally curved side 44 is adjacent to one of the curved corners 34 of the generally triangular opening 28. The radiusing of the curved side 44 is arranged to complement the radiusing of the corner 34 of the opening.

The other linear side 42 is more or less parallel to, but spaced from, the linear side 36 of the triangular opening 28 on the other side of the indentation.

In this way, the generally triangular indentations 40 form two strut root portions namely a linear strut root portion 46 and a curved or arcuate strut root portion 48.

This feature adds still further strength to the web.

Figure 6A:
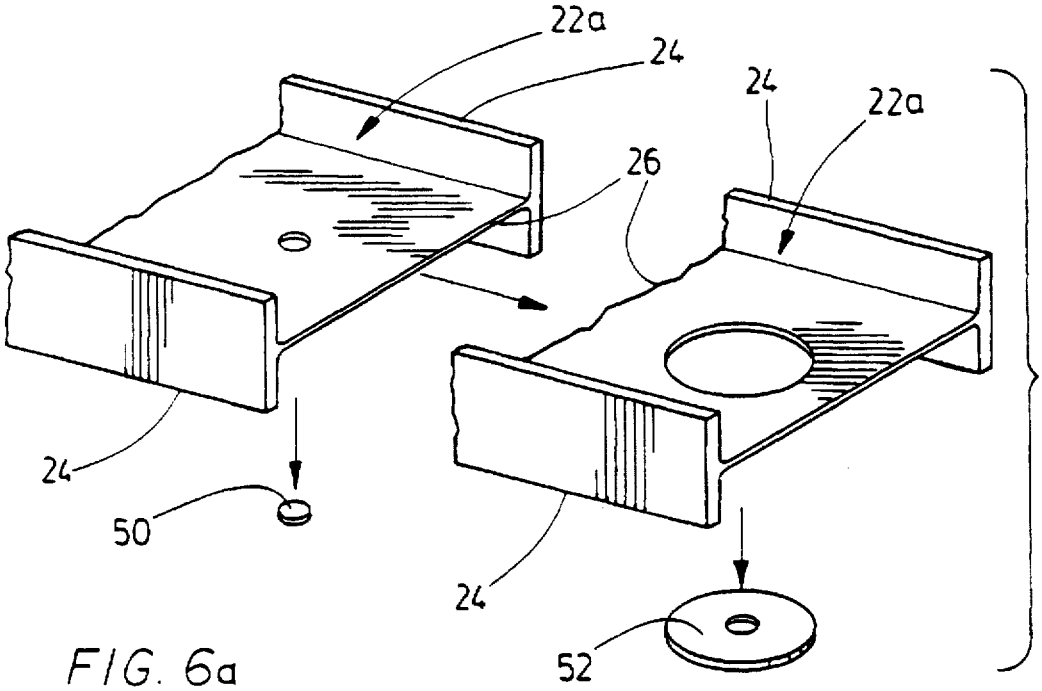
FIG. 6*a* and 6*b* are schematic stepwise illustrations illustrating a sequence of steps of forming an added value product, followed by an opening, in the web of the beam.
Figure 6B:
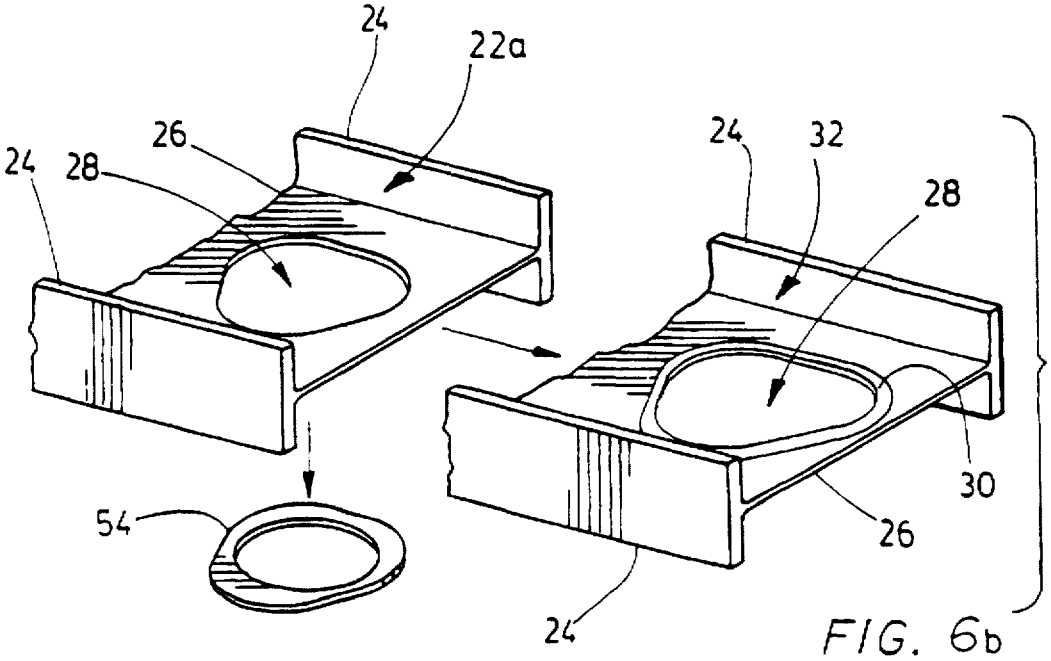

In a particularly preferred embodiment of the invention, the beam will be subjected to the action of two or more presses and die sets, one after the other. These die sets will perform a series of operations on the web as illustrated in FIGS. 6*a* and 6*b*.

The objective of this series of operations is to form an "added value" second component from the portion of the web which will be removed and normally discarded. In the simplest case, such an added value component may for example be a washer, although this is merely one example of many different second components which could be manufactured in this way.

Thus in order to form a washer as a second component, a first die set might punch a central hole 50, and a circular washer shaped portion 52. The second die set would punch out a scrap portion 54 to form the main opening 28 in the web surrounding the space from which the washer had been removed and would form lips 30 around the opening 28 and flatten the remainder of the web 26.

These various steps are shown separately, but would be performed in two die sets, or conceivably all in a single die set.

Figure 7:
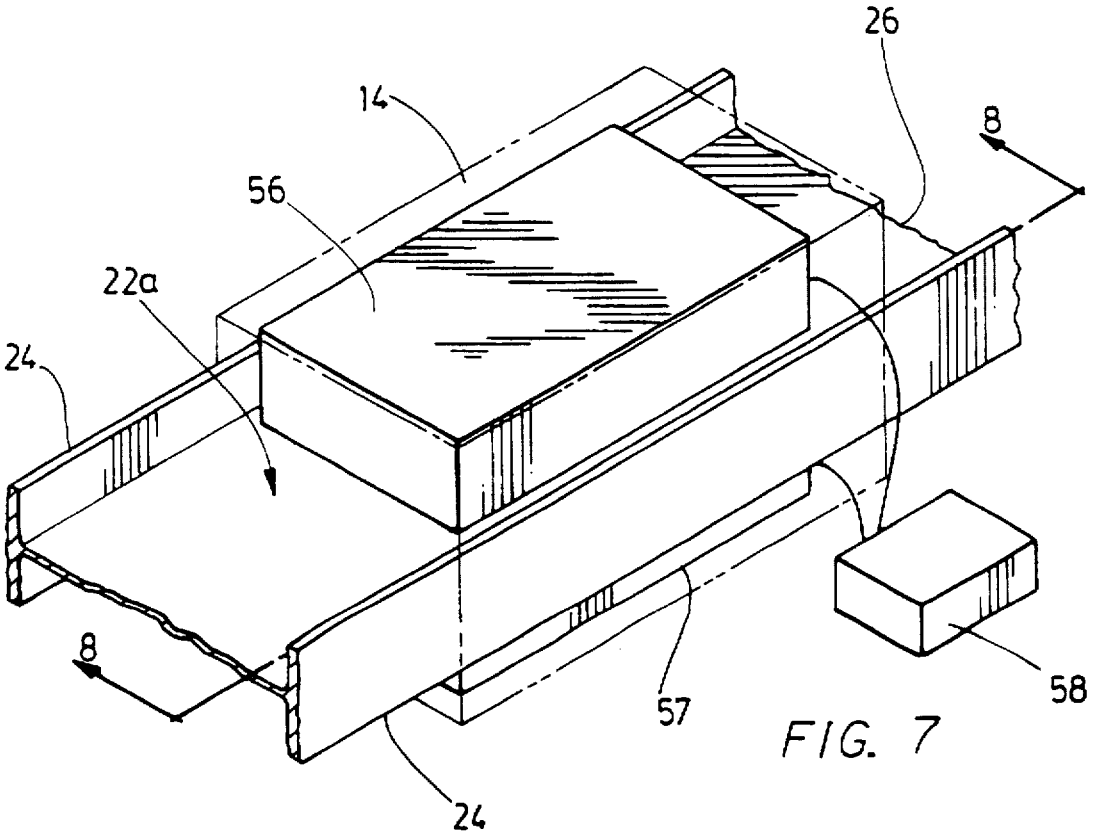
FIG. 7 is a schematic perspective illustration showing one form of the equipment for heating the web of the beam, without heating the flanges.
Figure 8:
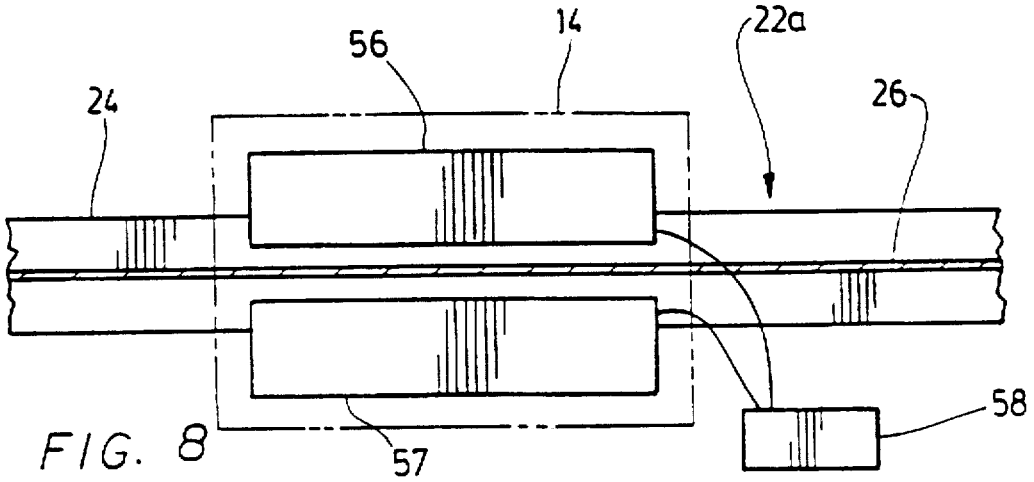
FIG. 8 is a section along the lines 8—8 of FIG. 7.

Heating of the web, without heating the flanges is efficiently performed, as showed in FIGS. 7 and 8, by means of upper and lower electrical induction heater elements 56 and 57, connected to a suitable electrical power source 58.

Such induction heaters may be located for the sake of convenience within a suitable enclosure or chamber schematically indicated in phantom as 14 in FIGS. 7 and 8.

Induction heaters of a suitable heating capacity will rapidly heat up the reduced thickness web while the beam is passed directly between them, so that they can be effectively used in a continuous production line, just up stream of the press. The induction heaters are of such a design that they will focus the heating effect directly on the web, without substantially heating the flanges, so that the web may be reheated to a "hot forming" temperature, typically of between 500 to 1200° C., with only a modest temperature rise in the temperature of the flanges, due to transmission of heat from the web to the flanges.

Induction heaters of this type can thus "focus" the heat directly on a desired portion of a beam. Other forms of heaters such as gas burners or radiant heaters may also be used.

Figure 9:
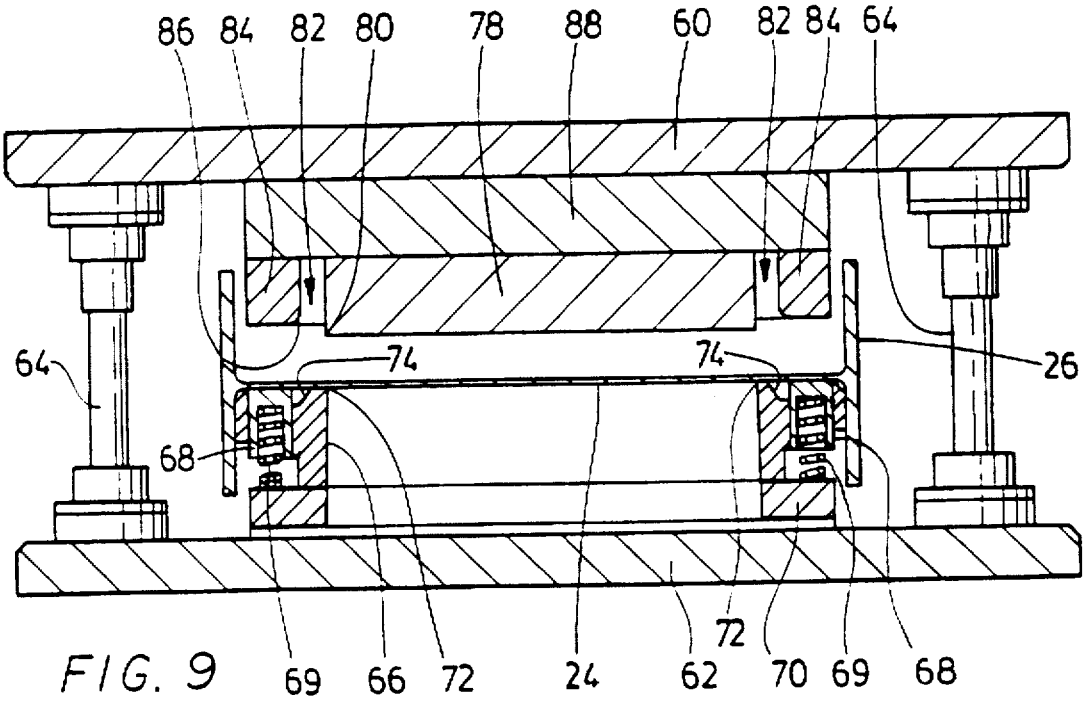
FIG. 9 is a section through a typical die set for forming openings and flanges and for flattening the web, shown open.
Figure 10:
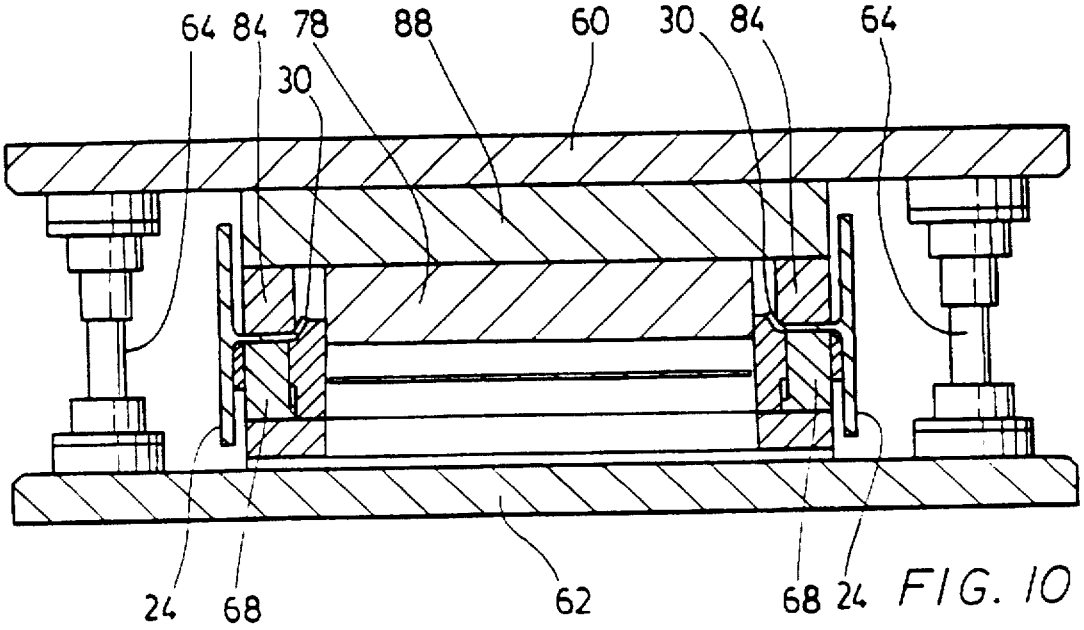
FIG. 10 is a section corresponding to FIG. 9 of the die set shown closed.

By way of example, a typical die set for use in a stationary press is illustrated in FIGS. 9 and 10.

It has conventional upper and lower plates 60 and 62 and guide rods 64. The lower die comprises an inner die portion 66 and an outer die planar forming portion 68, together supported on a platform 70. Lower die portion 68 is moveable upwardly and downwardly between the positions shown in FIGS. 9 and 10, and is normally urged upwardly by means of springs 69.The inner die portion 66 has an inner cutting edge 72, and a generally angled forming shoulder 74. The outer die portion 68 has a flat forming surface 76.

The upper die consists of a central punch portion 78, having cutting edges 80. Spaced therefrom by a space 82, there is an outer planar forming die portion 84, having a rounded forming shoulder 86.

The space 82 is adapted to receive a portion of the lower inner die 66, as shown in FIG. 10.

An upper die pad 88 supports the inner upper die 78 and the outer forming die portion 84.

Suitable fastenings and bolts will hold the various components together in accordance with well known practice in the art, and accordingly are not illustrated.

It will be noted that when the die set closes (FIG. 10) the discard portion, which may be the shape of the "added value" component 52 (FIG. 6*a*), or may be the shape of the discard portion shown at 54 in FIG. 6*b*, falls downwardly through the inner lower die 66, the web having been cut between the cutting edges 72 and 80.

As the die closes further, the upper outer forming die portion 84 forces the remainder of the web downwardly against the lower outer forming die portion 68, and against the shoulder 74.

The lower die portion 68 moves downwardly (FIG. 10) compressing springs 69. This flattens the web, and bends the lips 30 upwardly as shown.

This therefore forms the lips 30 around the openings.

Throughout this operation, the two flanges of the beam are left outside the die and are unaffected.

Spacers 90 may be placed on either side of the lower outer portion 68 in order to align the beam relative to the die set.

In order to speed up the operation the stationary press or presses may be replaced with one or more rotary presses as disclosed in U.S. Letters Pat. No. Re. 33,613 Granted Jun. 18, 1991 Inventor: Ernest R. Bodnar.

It has been found that by the practice of the invention, using a beam with a reduced thickness web and in which only the web is re-heated, and in which the flanges are left at a lower temperature during re-heating of the web, that it is then possible to pass the beam through a press, or through a series of presses, either stationary or rotary, with dies forming the web, without contacting the flanges. The flanges being straight and rigid and substantially unheated, enable the beam to be handled, while the web is formed hot, without the need for any extra support for the beam, or other special handling equipment, which would be required if the entire beam, ie. both flanges and web, were heated to the web forming temperature. In addition, by confining the heating only to the web there is a substantial reduction in operating cost, as compared with reheating the entire beam.

As an example of the savings that can be achieved by the invention, the following figures may be compared.

| | |
|---|---|
| Standard 400 mm I-beam (typical) | |
| Flange thickness | 8.3 mm |
| Web thickness | 6.3 mm |
| Web | no openings. |
| Improved 400 mm I-beam (typical) | |
| Flange thickness | 8.6 mm |
| Web thickness | 3–4 mm |
| Web metal removed at openings, 50% of web by mass. | |
| Standard 600 mm I-Beam (typical) | |
| Flange thickness | 11 mm |
| Web thickness | 8.5 mm |
| Web | no openings. |
| Improved 600 mm I-Beam (typical) | |
| Flange thickness | 11 mm |
| Web thickness | 4 to 5 mm. |
| Web metal removed at openings, 50% of web, by mass. | |
| Standard 800 mm I-Beam (typical) | |
| Flange thickness | 38 mm |
| Web thickness | 21 mm |
| Web | no openings. |
| Improved 800 mm I-Beam (typical) | |
| Flange thickness | 38 mm |
| Web thickness | 5 to 6 mm |

-continued

| | |
|---|---|
| Web metal removed at openings, 50% of web by mass. | |
| Standard 1000 mm Beam (typical) | |
| Flange thickness | 21 mm |
| Web thickness | 16 mm |
| Web | no openings. |
| Improved 1000 mm I-Beam (typical) | |
| Flange thickness | 21 mm |
| Web thickness | 6 to 7 mm |
| Web metal removed at openings, 50% of web by mass. | |

It is not possible to give examples for all specifications of standard beams and all specifications of improved beams.

From these figures it will be seen that major savings in weight are achieved in the 400 mm beam, and that savings are also obtained in the 600, 800, and 1000 mm beams.

Thus for example in the 400 mm beam, the ratio of flange thickness to web thickness may be expressed as follows;

Standard Beam:

Flange thickness to web thickness 1.5:1

Improved Beam:

Flange thickness to web thickness 3:1.

These ratios give some idea of the savings achieved by the method in accordance with the invention. The savings are achieved while maintaining substantially the same load carrying capacity as compared with standard solid web beams, having the same flange width and thickness, and having the same web depth.

The moment resistances of a standard beam and an improved beam specimen were calculated by $$Mr=Zpln(Fy)$$

where Zpln is the net plastic section modulus on the basis of a 200 mm perforation depth and Fy is the yield strength of the steel. The moment resistance, Mr of the standard solid web beam, and the test moment M for the improved beam specimen tested are set out below. Assume Fy=300MPa Standard Beam 400 mm (nominal)×140 mm×39 mm (m=38.6 kg/m; tw=6.3 mm)–

$$Mr/m = \frac{215kN \cdot m}{38.6} = 5.57$$

Improved pierced web beam as tested 400 mm nominal×140 mm×39 mm (m=31–4.5°=26.5 kg/m; tw=3 mm)–Mass reduction of perforations $$Mr/m = \frac{188kN \cdot m}{26.5} = 7.09$$

In accordance with a further feature of the invention, the lips around the openings can be subjected to a hot forging operation, substantially simultaneously with the piercing of the openings and the bending of the lips.

Such further embodiment is illustrated in the modified die set shown in FIGS. 11, 12, 13 and 14. These illustrations correspond in many ways to the illustrations of the die sets shown in FIGS. 9 and 10. Thus the modified die set comprises an upper male die 100 and a lower female die 102. The upper male die 100 comprises a top plate 104, mounted on upper die pins 106. A central pad plate 108 supports an inner male die 100.

An outer lip-bending die 112 is also supported on pad plate 108. Between the inner cutting die 110 and the outer bending die 112, there is an intermediate forging die portion 114. Forging die portion 114 defines a forging head 116.

The outer planar forming die portion 112 is slidably mounted by shoulder 117 on forging die 114. A cam follower 118 is mounted on outer bending die 112. Cam follower 118 has an angled upper end received in a cam slot 120 in cam bar 122.

The outer end of cam bar 122 is angled at 124, and rides on a fixed abutment member 126. Abutment member 126 is mounted on the upper end of post 128, and is adapted to be received in a groove 130 in plate 104. Post 128 is mounted on the lower die 102, described below.

In this way, outer planar forming die portion 112 is moveable upwardly and downwardly under the control of cam bar 122. Die portion 112 is normally urged into a lower position by springs (not shown).

A buffer portion 132 is secured to the underside of plate 104, and bears against the outer surface of abutment 126 on the post 128.

The lower die 102 comprises a plate 134, on which is mounted an inner cutting die member 136, and an outer planar forming die member 138. Outer forming die 138 is slidable upwardly and downwardly, and is normally urged upwardly by springs (not shown) similar to those shown in connection with the die set in FIGS. 9 and 10.

The lower cutting die member 136 has an inner cutting edge 140, and an outer die surface 142 having a curved shoulder 143. Die surface 142 defines a predetermined spacing between itself and the inner surface 144 of upper forming die portion 112. Inner surface 144 defines a radius around which the lip of the web will be bent and shaped. The spacing between the outer surface 142 of lower cutting die 136, and the surface 144 of the upper forming die 112 is greater than the thickness of the web metal.

Figure 11:
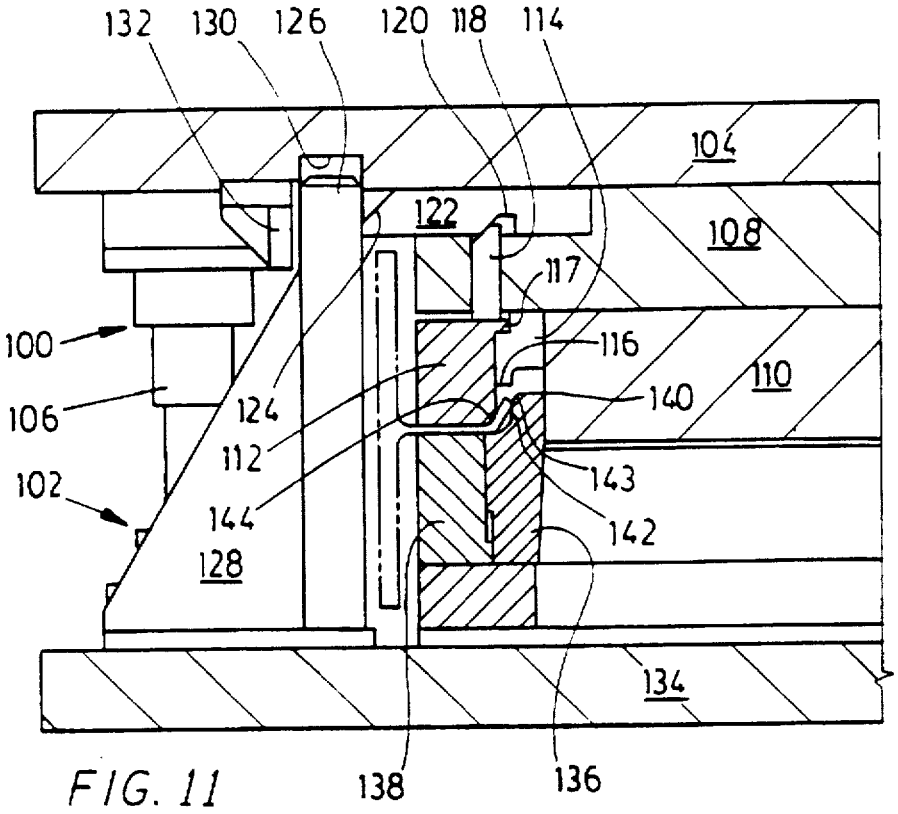
FIG. 11 is a section, corresponding to FIG. 9, of an alternate embodiment of a die set, for forging the lips around the openings, in a first partially closed position.
Figure 13:
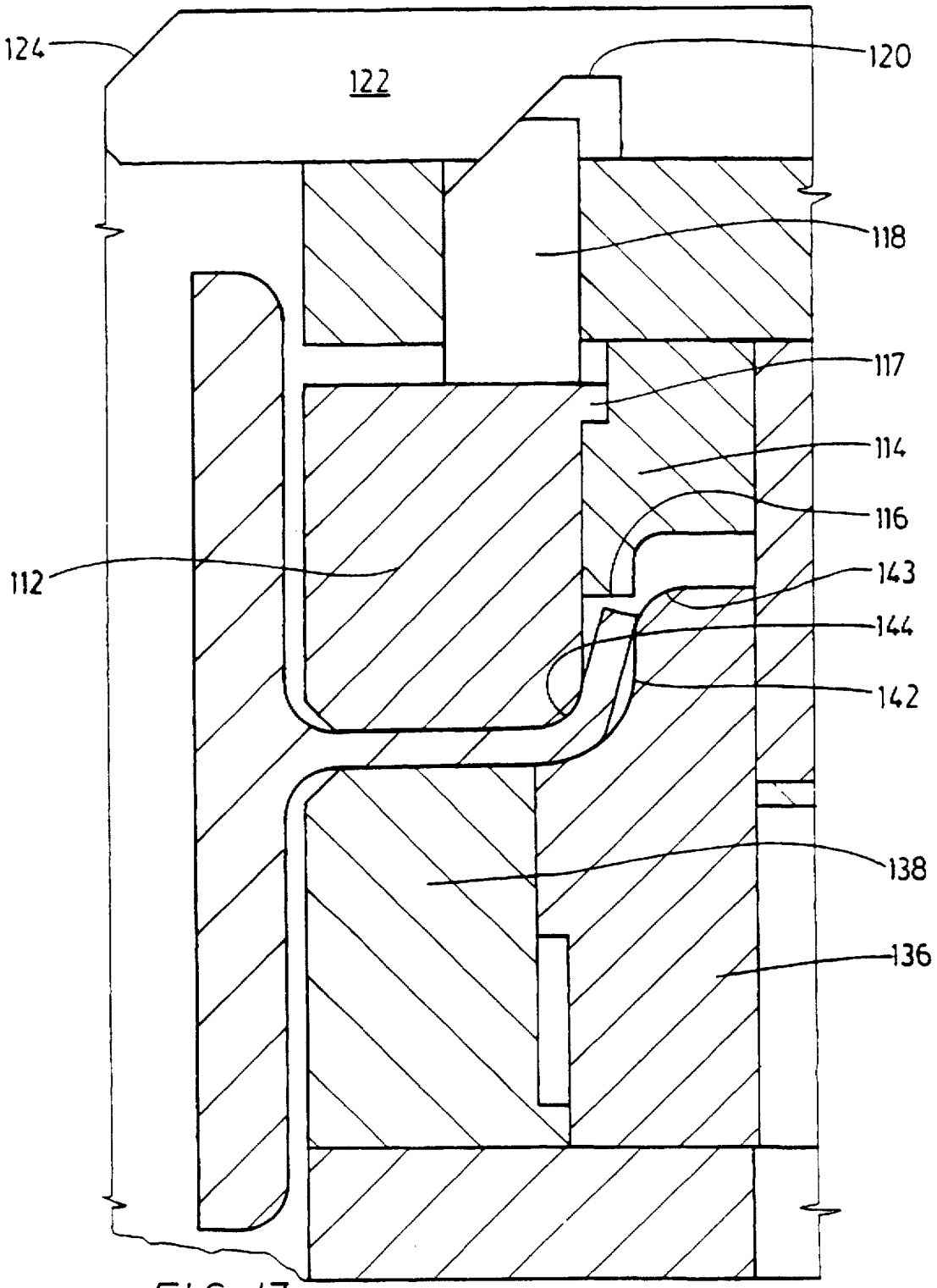
FIG. 13 is an enlarged section of a detail of FIG. 11.

In operation, when the dies 100 and 102 close to their cutting and bending position (FIG. 11 and 13), the web is cut, and the lip is bent substantially as shown in FIGS. 11, and 13.

As the upper die continues to close however the upper outer die portion 112 has already bottomed out, and cannot move further. In the bending position (FIG. 11) the outer forming die 112 is held downwardly by means of post 128 engaging cam bar 122.

Figure 12:
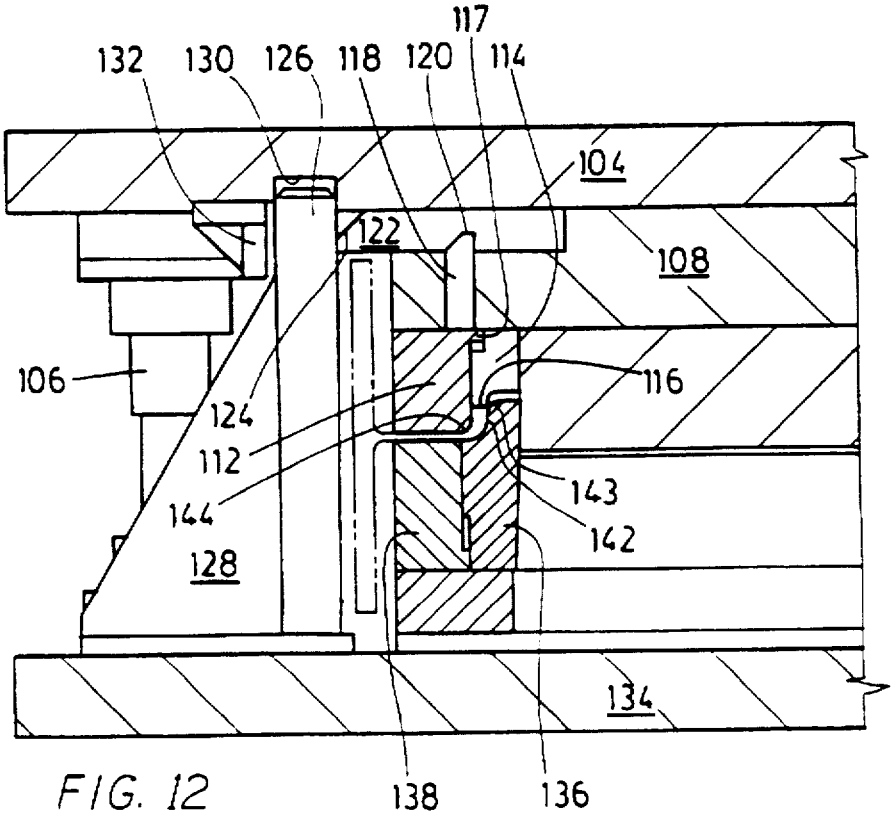
FIG. 12 is section corresponding to FIG. 11 showing the alternate die set closed, forging and thickening the lips.
Figure 14:
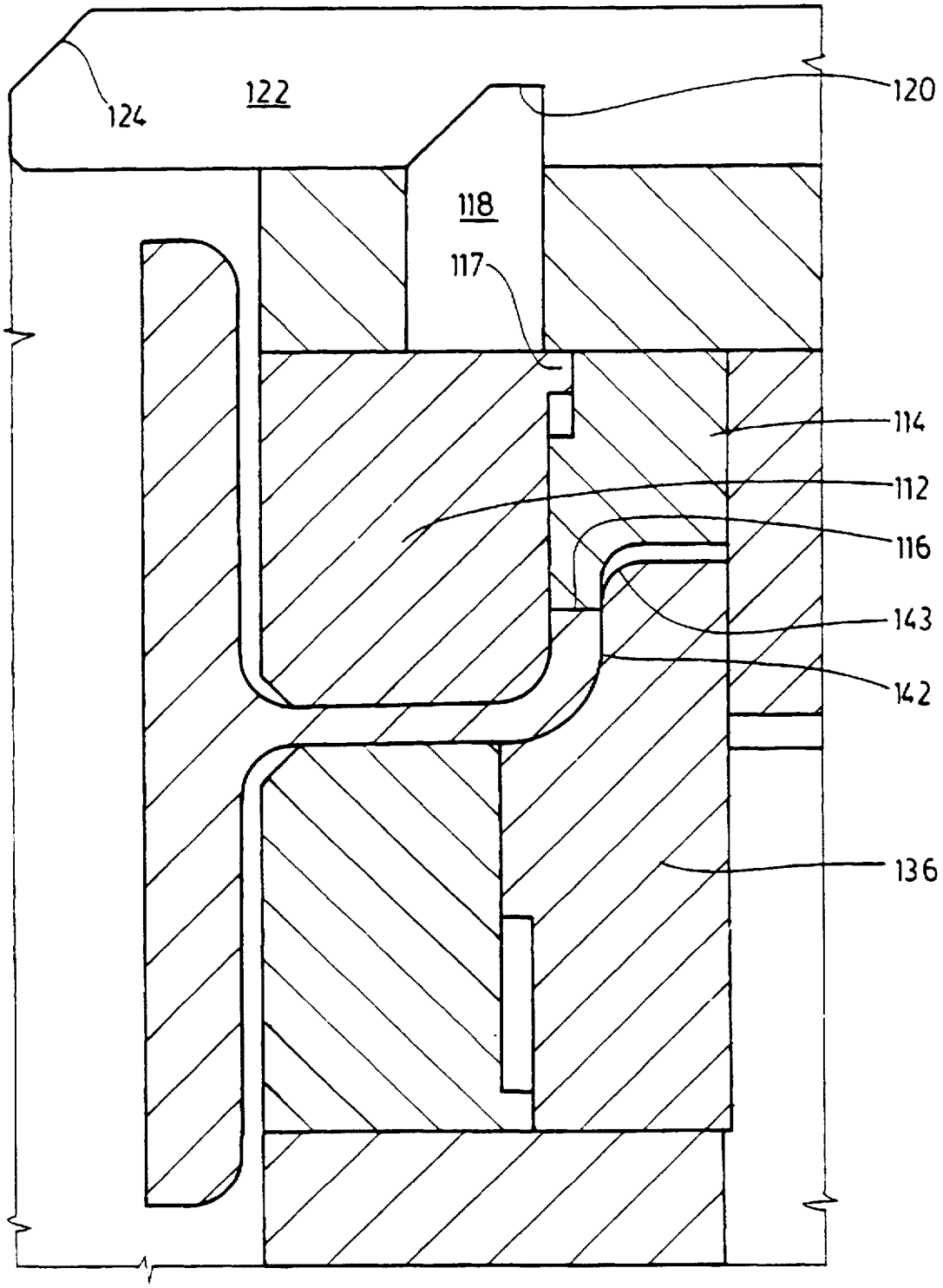
FIG. 14 is an enlarged section of a detail of FIG. 12.

However, at the point indicated in FIG. 11, where the upper forming die 112 has bottomed out, cam surface 124 of cam bar 122 is adapted to ride on abutment 126, so that cam bar 122 can slide slightly to the left hand side (FIG. 12), as post 128 rises up into cam slot 120. This movement will then allow die plate 104 and pad 108 and the remaining members connected thereto to descend somewhat further into the closed forged position as shown in FIG. 12 and 14 without the outer forming die 112 moving any further.

This will then cause the forging head 116 to descend into the space between surfaces 142 and 144. This will then engage the upwardly angled edge of the lip, and will force it down into the space between surfaces 142 and 144.

This will thus forge the edge of the lip, and both increase the angle of the lip relative to the web and at the same time increase the thickness of the lip beyond the thickness of the web, and also somewhat reduce the depth of the lip.

A web formed with openings and with forged lips around the openings thicker than the web, in this manner, will have greatly increased strength. The increased angle of bend achieved by the lip will also provide still further strength to the web, and increase the dimensions of the opening.

All of these factors can be achieved in a single die, in a highly advantageous and efficient manner.

Figure 15:
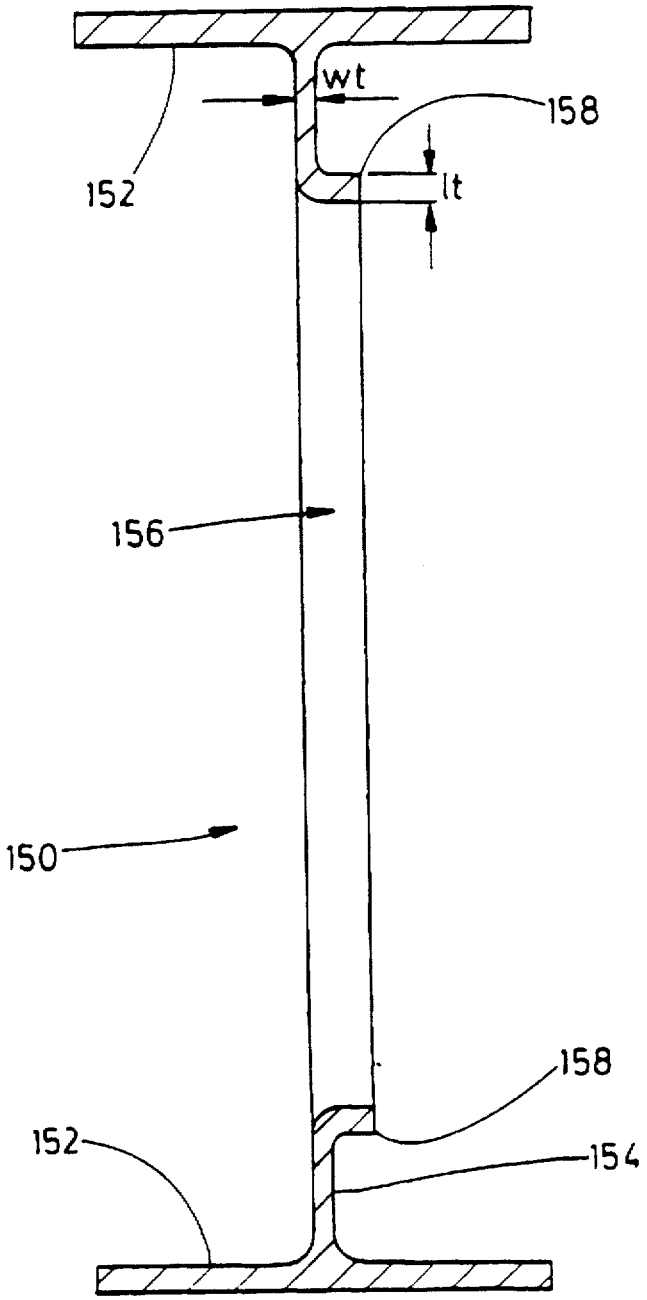
FIG. 15 is a section of a beam with a hot forged web and lips, when formed in the dies of FIGS. 11 and 12.

Referring now to FIG. 15, a beam formed in the modified forging die described above is illustrated in section.

The modified beam is indicated generally as 150, and comprises upper and lower flanges 152, of a first predetermined thickness less than the first, and a web 154 of a second predetermined thickness. An opening 156 is shown formed through the web 154, and lips 158 are shown formed around the opening.

It will be seen that the lips 158 are bent at an angle of substantially about 90 degrees to the plane of the web 154. In addition it will be seen that the lips 158 have a thickness Lt greater than the thickness of Wt of the web 154.

This increase in thickness of the lips 158, results from the hot forging of the lips in the manner described above.

The 90 degree angle of the lips, as well as the increased thickness of the lips, provides great additional strength to the web 154.

In addition, it increases the open area defined by the opening 156. This still further improves the ability of the beam to pass services through the beam.

While the beam illustrated is in the form of an I beam with a pierced web, it will be appreciated that many other types of beam sections may be greatly improved in accordance with the invention.

The foregoing is a description of a preferred embodiment of the invention which is given here by way of example only. The invention is not to be taken as limited to any of the specific features as described, but comprehends all such variations thereof as come within the scope of the appended claims.

I claim:

1. A method of manufacturing a one piece integral metallic beam (22) having flanges (24), and a web (26) joining said flanges, said beam having been hot rolled from a heated metal workpiece (20), to produce an integral one piece beam having flanges, and a web extending therebetween, said flanges having a predetermined first thickness, and said web having a predetermined second thickness less than said first thickness, and characterized by the steps of;

heating said web (26) to a hot forming temperature; passing said heated web (26) through at least one metal forming die set (16) for forming openings in (28) said web, and planar clamping die portions for flattening said web;

repeatedly closing said at least one die set (16) on said web (26), without forming said flanges (24), whereby to form openings (28) in said web (26);

wherein said step of closing said at least one die set (16) on said web (26) forms lips (30) around said openings (28), at an angle to said web; and, clamping said web (26) to flatten said web (26) around said openings (28).

2. A method of manufacturing a beam as claimed in claim 1 wherein said openings (28) are of generally triangular shape with rounded corners, said openings being directed alternately towards opposite flanges (24) of said beam, and said openings defining strut portions (38) therebetween extending in a generally diagonal fashion from one side of said web to the other, and said lips (30) extending along either side of said strut portions (38) whereby to give the same a generally channel shaped cross-section.

3. A method of manufacturing a beam as claimed in claim 2 and including the steps of forming generally triangular indentations (40) in said web at each end of each of said strut portions (28).

4. A method manufacturing a beam as claimed in claim 3 wherein said generally triangular indentations (40) have a linear side (42) parallel to a said flange (24), and a further linear side (42) parallel to one side of an adjacent opening (28), and a curved side (44) adjacent to a rounded corner (34) of an adjacent said opening, whereby to define separate strut root portions (46,48) on either side of said triangular indentations (40).

5. A method of manufacturing a beam as claimed in claim 1 wherein said beam is an I-beam, and said web (26) has a depth of approximately 400 mm, and wherein said flanges (24) have a thickness of between about 8 and 9 mm, and said web (26) has a thickness of between 3 and 4 mm.

6. A method of manufacturing a beam as claimed in claim 1 wherein said web (26) has a depth of approximately 600 mm, and wherein said flanges (24) have a thickness of between about 11 to 12 mm and said web (26) has a thickness of between 4 and 5 mm.

7. A method of manufacturing a beam as claimed in claim 1 wherein said web (26) has a depth of approximately 800 mm, and wherein said flanges (24) have a thickness of between about 38 and 39 mm and said web (26) has a thickness of between about 5 and 6 mm.

8. A method of manufacturing a beam as claimed in claim 1 wherein said web (26) has a depth of approximately 1000 mm, and wherein said flanges (24) have a thickness of between about 21 and 22 mm and said web (26) has a thickness of between about 6 and 7 mm.

9. A method of manufacturing a beam as claimed in claim 1 wherein said flanges (24) have a thickness of T and said web (26) has a thickness of t and wherein the ratio of T:t is about 3:1 or greater.

10. A method of manufacturing a one piece integral metallic beam having flanges (24), and a web (26) joining said flanges, and being characterized by;

hot rolling a heated metal workpiece (20), to produce an integral one piece beam (22) having flanges (24), and a web (26) extending therebetween, said flanges having a predetermined first thickness T, and said web having a predetermined second thickness t less than said first thickness, and wherein the ratio of T:t is 3:1 or greater;

re-heating said web (26) to a hot forming temperature; passing said heated web (26) through at least one metal forming die set (16) for forming openings (28) and lips (30) around said openings (28), and having planar clamping die portions (84) for flattening said web, repeatedly closing said at least one die set (16) on said web (26), whereby to form said lips (30) and to flatten said web (26), without forming said flanges (24), whereby said planar clamping die portions (84) flatten said web.

11. An apparatus for manufacturing a one-piece integral metallic beam having flanges, and a web joining said flanges, said beam having been hot rolled from a heated metal workpiece (22), said apparatus being characterized by;

heating means (56,57) for heating said web (26), without substantially heating said flanges (24);

at least one metal die forming set (16), in turn comprising;

a piercing die portion (78) for piercing an opening (28) through said heated web (26);

a bending die portion (72,80) for bending lips (30) around said opening (28); and, flattening die portions (68,84) for engaging said web (26) around said lips (30), and flattening said web (26), whereby to pierce openings (28) through said web (26) at spaced intervals, and to bend lips (30) around said openings (28), and to flatten the remainder of said web between said flanges.

12. An apparatus as claimed in claim 11 and wherein said heating means (56) comprises induction heating means (56,57,58) spaced apart from one another, and adapted to receive said web (26) of said beam therebetween, and to focus heat on said web (26), with said flanges (24) of said beam being outside said induction heating means, whereby to avoid substantial heating of said flanges.

13. An apparatus as claimed in claim 12 and including secondary component die means (72,78) for forming a secondary component (52) from said web (26), within said opening (28), prior to piercing of said opening through said web.

14. A metal piercing, forming and forging die for forming a beam with openings, and lips, and being characterized by;

a piercing die portion (110), for piercing an opening (28) in a metal workpiece (26);

a forming die portion (136) for bending lip portions with free edges (30) of said metal workpiece alongside said opening (28), and, a forging die portion (116) between said piercing die portion and said forming die portion (136), said forming die portion being moveable relative to said forging die portion, whereby said free edges of said lip portions are forged by said forging die portion (116) and are increased in thickness.

15. A method of manufacturing a one piece integral metallic beam (22) having flanges (24), and a web (26) joining said flanges, said beam having been hot rolled from a heated metal workpiece (20), to produce an integral one piece beam having flanges, and a web extending therebetween said flanges predetermined first thickness, and said web having a predetermined second thickness less that said first thickness, and characterized by the steps of;

heating said web (26) to a hot forming temperature while maintaining said flanges (24) at a reduced temperature, so as to facilitate the handling of said beam; passing said heated web (26) through at least one metal forming die set (16) for forming openings in (28) said web, and planar clamping die portions for flattening said web;

repeatedly closing said at least one die set (16) on said web (26), without forming said flanges (24), whereby to form openings (28) in said web (26);

wherein said step of closing said at least one die set (16) on said web (26) forms lips (30) around said openings (28), at an angle to said web; and, clamping said web (26) to flatten said web (26) around said openings (28).

16. A method of manufacturing a one piece integral metallic beam (22) having flanges (24), and a web (26) joining said flanges, said beam having been hot rolled from a heated metal workpiece (20), to produce an integral one piece beam having flanges, and a web extending therebetween, said flanges having a predetermined first thickness, and said web having a predetermined second thickness less that said first thickness, and characterized by the steps of;

heating said web (26) to a hot forming temperature; passing said heated web (26) through at least one metal forming die set (16) for forming openings in (28) said web, and planar clamping die portions for flattening said web;

repeatedly closing said at least one die set (16) on said web (26), without forming said flanges (24), whereby to form openings (28) in said web (26);

wherein said step of closing said at least one die set (16) on said web (26) forms lips (30) around said openings (28), at an angle to said web;

hot forging said lips (30), whereby to increase said angle of said lips (30), relative to said web (26), and also to increase the thickness of said lips (30) relative to said web; and, clamping said web (26) to flatten said web (26) around said openings (28).

17. A method of manufacturing a one piece integral metallic beam (22) having flanges (24), and a web (26) joining said flanges, said beam having been hot rolled from a heated metal workpiece (20), to produce an integral one piece beam having flanges, and a web extending therebetween, said flanges having a predetermined first thickness, and said web having a predetermined second thickness less that said first thickness, and characterized by the steps of;

heating said web (26) to a hot forming temperature; passing said heated web (26) through at least one metal forming die set (16) for forming openings in (28) said web, and planar clamping die portions for flattening said web;

repeatedly closing said at least one die set (16) on said web (26), without forming said flanges (24), to form portions (52) of said web (26) within said openings (28),prior to removal of portions of said web from said openings, so as to form an added value product (52) from said web, subsequently removing portions (54) of said web around said added value product, to form openings (28) in said web (26);

wherein said step of closing said at least one die set (16) on said web (26) forms lips (30) around said openings (28), at an angle to said web; and, clamping said web (26) to flatten said web (26) around said openings (28).

* * * * *